US005295277A

United States Patent [19]

Koenigs et al.

[11] Patent Number: 5,295,277

[45] Date of Patent: Mar. 22, 1994

[54] CONVERTIBLE SWEEPER

[75] Inventors: Philip E. Koenigs, New Hope; Michael T. Basham, Maple Grove, both of Minn.

[73] Assignee: Tennant Company, Minneapolis, Minn.

[21] Appl. No.: 989,758

[22] Filed: Dec. 14, 1992

[51] Int. Cl.[5] ..... E01H 1/04

[52] U.S. Cl. ..... 15/83; 15/340.4

[58] Field of Search ..... 15/83, 84, 340.4, 85, 15/86

[56] References Cited

U.S. PATENT DOCUMENTS

| | | | |
|---|---|---|---|
| 884,421 | 4/1908 | Ruff | 15/84 |
| 959,380 | 5/1910 | Otis | 15/84 |
| 4,569,096 | 2/1986 | Kassai | 15/83 |
| 4,624,026 | 11/1986 | Olson et al. | 15/83 |

FOREIGN PATENT DOCUMENTS

| | | | |
|---|---|---|---|
| 7668 | of 1914 | United Kingdom | 15/84 |

*Primary Examiner*—Edward L. Roberts

*Attorney, Agent, or Firm*—Kinzer, Plyer, Dorn, McEachran & Jambor

[57] ABSTRACT

A convertible sweeper has a main rotating cylindrical brush and a second rotatable cylindrical tool. The second tool is movable between a first position in front of the main brush where it rotates to assist in very effectively loading debris comprised mainly of dry leaves, paper, etc. into the hopper, and a second position in the upper part of the hopper entrance. There it may be held stationary when the debris to be swept is mainly sand, which is very efficiently swept by the main brush alone, or it may be rotated if the debris also includes some light material, because such rotation assists to a degree in loading that material.

18 Claims, 4 Drawing Sheets

CONVERTIBLE SWEEPER

BACKGROUND

There is a class of sweeping machines which contact the floor or ground being swept with a cylindrical brush that lifts debris from the surface and throws it forward directly into a debris hopper located in front of the brush. Such machines are referred to as direct forward throw sweepers, and it is sometimes said that they use a "broom and dustpan" sweeping principle. The debris hopper of such a machine is open at the rear for entrance of debris, and the hopper floor is set close to the ground, at least in the entrance area. A rubber lip is commonly attached to the rear edge of the hopper floor and made so it drags on the ground, so the hopper is in fact built somewhat like a dust pan, and the rotating broom sweeps debris into it. U.S. Pat. No. 3,189,931 (Peabody) and U.S. Pat. No. 3,304,572 (Wendel) show representative sweepers of this class. In this discussion we will refer to the sweeping principle used in such machines as the conventional sweeping mode.

Such sweepers have been used for many years, and their operating characteristics are well known. They are recognized as being extremely efficient in sweeping fine, dense debris such as sand and gravel. Starting from ground level, they throw such material in a low trajectory well forward in the hopper and easily load the hopper to its capacity. However, they do less well in sweeping and hopper loading of light debris such as, for example, crumpled paper items or dry leaves. This is primarily because air resistance checks the flight of light debris to the front of the hopper. Much of it falls in the rear of the hopper, where it builds up and blocks the hopper entrance before the hopper is full.

In the mid '80's a two-tool sweeper design emerged which was much superior in loading light debris. Shown in U.S. Pat. No. 4,624,026 (Olson), it used the conventional sweeping brush, but in addition a smaller cylindrical brush or paddle wheel was placed in front of the brush so it just cleared the ground and was rotated opposite to the sweeping brush rotation. These two tools cooperatively threw debris in a much higher trajectory than direct forward throw sweepers. In this trajectory the debris entered the hopper at a higher level than before. Even light debris travelled farther forward in the hopper before it came to rest, so almost a full hopper load of it could be collected. Sweepers built to this design were outstanding in their ability to sweep and hopper load light debris.

However, they did not sweep sand and gravel as well as the direct forward throw sweepers. Sand, when thrown by a sweeper brush, fans out to some degree, like a shotgun pattern. This did not affect the low trajectory of the direct forward throw sweepers, but in the high trajectory of the two-tool sweepers a small portion of the sand fanned out enough to fall back into the top of the sweeping brush rather than flying forward into the hopper. The rotating brush carried it backward and dropped it behind the brush, where it could not be swept up. Only a small percentage of the sand was lost in this way, but it was enough to create dissatisfaction with sweeper operation.

A need exists for a sweeper that will sweep dense debris such as sand and gravel as efficiently as a conventional direct forward throw sweeper, and also will sweep and hopper load light debris such as crumpled paper items or dry leaves as efficiently as a two-tool sweeper. A mixture of dense and light debris should also be efficiently swept and hopper loaded.

SUMMARY OF THE INVENTION

The present invention discloses a convertible sweeper which can be selectively operated in any one of three sweeping modes. In one mode, referred to as conventional direct forward throw mode, it uses a single sweeping brush, and is highly efficient in sweeping and hopper loading dense debris such as sand or gravel. In a second mode, termed a two-tool mode, it becomes a two-tool sweeper like those described earlier and does an outstanding job of sweeping and hopper loading debris which consists primarily of light material such as crumpled paper items or dry leaves. A third mode is also disclosed which may be optimum for sweeping and hopper loading mixed dense and light debris. Thus it provides in one machine three diverse sweeping modes, two of which previously were found only in separate sweepers, and a third which is believed to be new and novel.

In the sweeper of the present invention a conventional sweeping brush is provided, which will be referred to as the rear brush, and a conventional hopper is placed in front of it. The hopper has the usual rear opening and rubber sweeping lip, the latter dragging on the surface being swept. These components are used alone in the conventional direct forward throw sweeping mode, and they provide excellent sweeping and hopper loading of small, dense debris such as, for example, sand and gravel.

The present sweeper also has a second rotatable tool, which in this discussion will be referred to as the front brush. However, unlike the design described in U.S. Pat. No. 4,624,026, this second tool, or front brush, in the present invention is mounted on a movable structure which permits it to be placed in either of two positions. In the conventional sweeping mode it is retracted into a location where it does not interfere with the direct forward throw of dense debris into the hopper by the rear brush, which is operational. But in the two-tool mode it is moved to a location in front of the rear brush, behind the hopper opening and adjacent to or contacting the surface being swept. In use it is rotated opposite to the direction of rotation of the rear brush, as described in '026, and this results in a very superior sweeping and hopper loading of light debris such as, for example, crumpled paper items or dry leaves.

The present invention recognized that a sweeper can be built having the advantages of both conventional direct forward throw sweepers and known two-tool sweepers by providing both conventional and two-tool components in one sweeper, so arranged that one or the other mode can be used, depending on the type of debris to be swept. In this invention the two-tool sweeper design of the '026 patent was modified and installed in a sweeper having a conventional hopper entrance and sweeping lip at the rear of the hopper. This permits two-tool operation, and also allows conventional direct forward throw sweeping by selectively removing the front brush when desired from in front of the sweeping brush and close to the surface being swept. In the present invention a front brush was installed in a conventional sweeper with an innovative mounting comprising a lift system, related linkages and controls so that a sweeper operator could selectively place the front brush in operative position and activate it or place it in a storage position. This latter position was high in the hopper entrance where it did not interfere with the low trajectory of conventionally swept dense debris thrown by the rear brush acting alone.

The rotation of the front brush may be stopped when it is in storage position, but under some circumstances there is an advantage to rotating it Primarily this advantage occur when sweeping a mixture of dense debris such as sand and light debris such as paper in the conventional sweeping mode. The rear brush throws the sand directly into the hopper in good fashion, but the paper tends to lob into the top of the hopper entrance, often striking the front brush stored there, and dropping short into the rear of the hopper.

However, if the front brush when located in the upper part of the hopper entrance is rotated in the same direction as the rear brush, any paper striking it will be propelled well forward in the hopper. This has come to be known as assisted conventional mode, and results in better hopper loading of paper than is experienced in unassisted conventional mode, though not as good as in two-tool mode. It may be a preferred mode of operation in situations where the emphasis is on highly efficient sand sweeping, but there is some light debris mixed with the sand. Placing the front brush in the upper part of the hopper entrance does not interfere with the trajectory of sand being thrown directly into the hopper by the rear brush, irrespective of whether the front brush is or is not rotated.

Thus the objective of the invention is to provide a conventional direct forward throw sweeping mode and a two-tool sweeping mode in one sweeper, with an option to provide an assisted conventional mode, and convenient means to convert the operation of the sweeper from one to another of the modes.

DETAILED DESCRIPTION OF THE INVENTION

Figure 1:
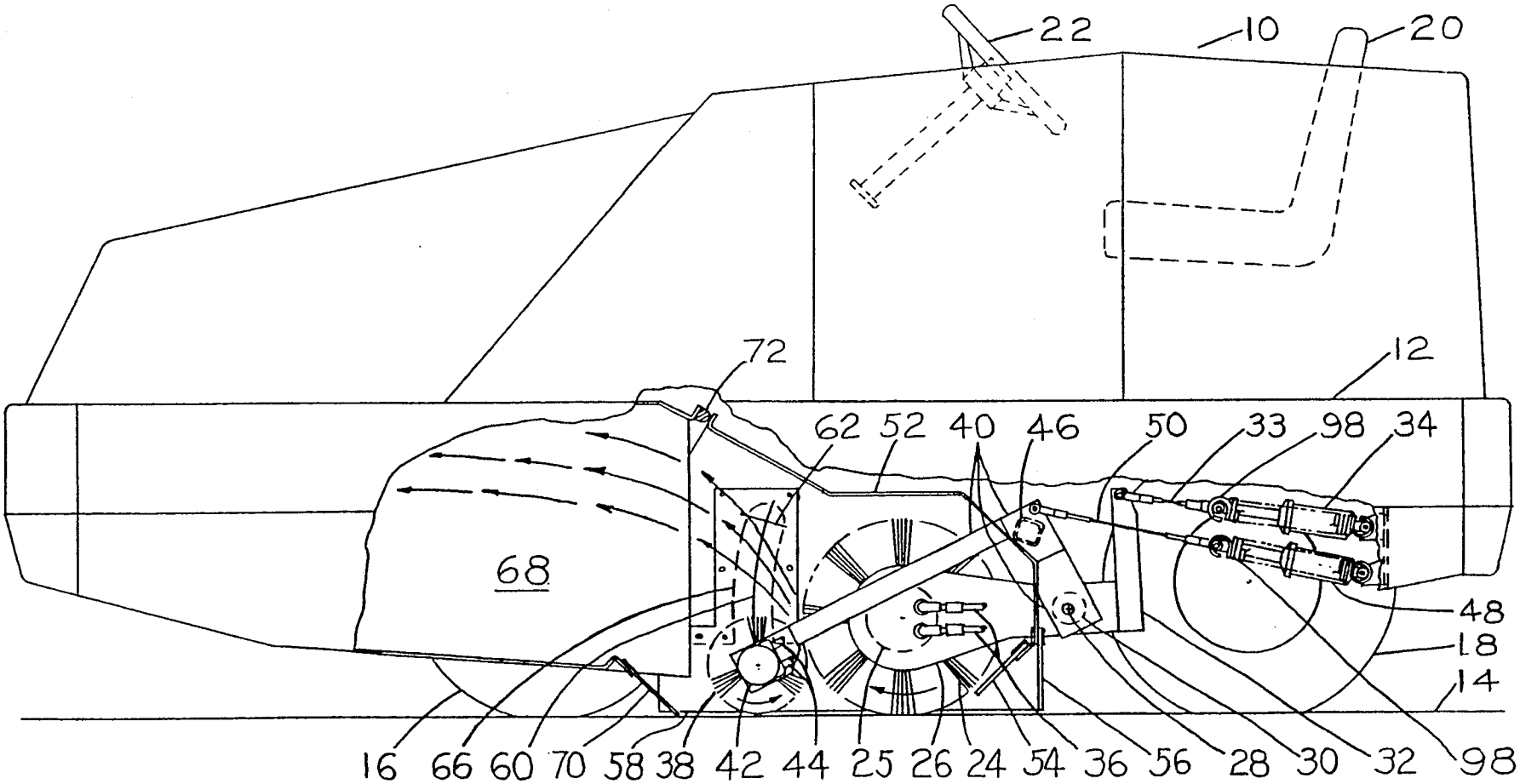
FIG. 1 is a side view of a sweeper with portions broken away to show the front brush and rear brush of the present invention sweeping light debris in the so-called two-tool sweeping mode.

Referring now to FIG. 1, at 10 there is shown a sweeper which uses a preferred embodiment of the present invention. The sweeper has a frame, shown generally at 12, and is supported on a surface to be swept 14 by two free rolling front wheels 16 (only one shown) and one steerable, powered rear wheel 18. Provisions for a driver are indicated generally by a seat 20 and a steering wheel 22. Other conventional controls are also provided, but are not shown.

Figure 2:
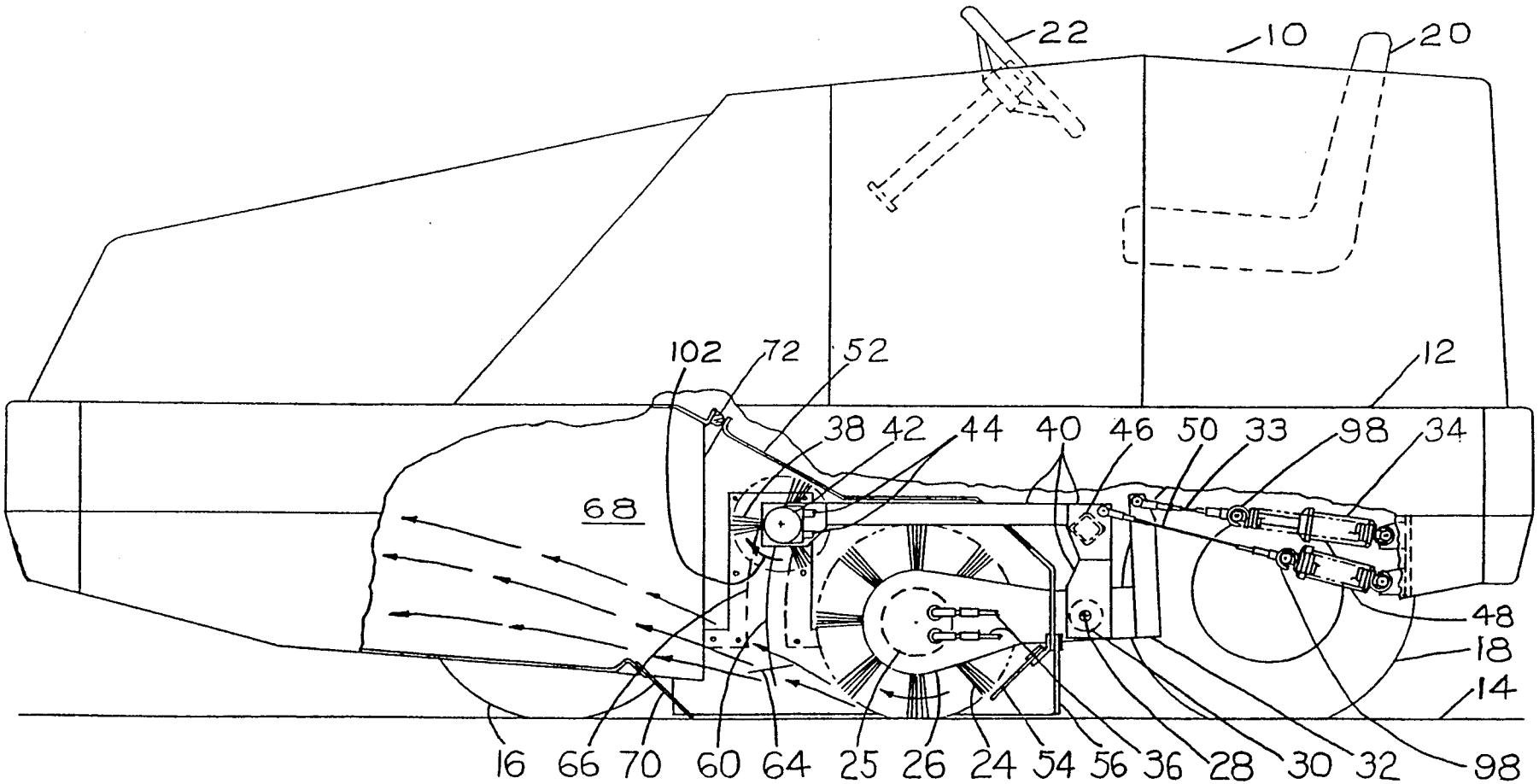
FIG. 2 is similar to FIG. 1, but shows the front brush lifted and the rear brush sweeping dense debris in the so-called conventional sweeping mode. The front brush may be considered to be not rotating, as in the conventional sweeping mode, or it may be considered to be rotating as in the assisted conventional mode, with the direction of its rotation indicated.

A conventional cylindrical sweeping brush 24, which will be referred to as the rear brush, is mounted in a conventional manner and extends across most of the transverse width of the machine. It is supported between two brush arms 26 (only one shown) which are attached in pivotal manner to the sides of the frame 12 at two transversely aligned points 28 (only one shown). A cross shaft 30 joins the two brush arms 26 together so that both ends of brush 24 are maintained in alignment. A lift arm 32 is welded or otherwise attached to one brush arm, and is pivotally connected at its upper end to a cable assembly 33. This connects to a hydraulic cylinder 34 by means of which the brush 24 can be raised off the surface 14 for transport, or lowered to its working position which is shown in FIGS. 1 and 2. In working position cable assembly 33 may be slack and the engagement of rear brush 24 with surface 14 may be controlled by an adjustable down stop (not shown). This may be made in any one of several conventional ways. Commonly such a stop is a heavy screw bearing against a lug welded to cross shaft 30. A knob on the opposite end of the screw will be accessible to the driver. By turning the knob he or she can set the brush height for a desired floor contact, or pattern, and can re-set it when needed as the brush wears. Brush 24 is rotated by a hydraulic motor indicated at 25 which is attached to the in-board side of one brush arm 26. This motor is supplied by hoses indicated at 36. The hydraulic system will be described in greater detail later. The opposite brush arm 26 (not shown) carries an idler bearing assembly which rotatably supports the opposite end of brush 24.

A second tool 38 may be a cylindrical brush or a paddle wheel. In this discussion it will be referred to as the front brush. In purpose, function and construction it is similar to the rotary lip described in U.S. Pat. No. 4,624,026. It extends essentially across the transverse width of the machine, being essentially equal in length to the rear brush. It may be approximately half the diameter of the rear brush 24. When in use in the so-called two-tool mode of operation as shown in FIG. 1, it is located directly in front of the rear brush 24, which is to say it is immediately to the left of brush 24 as seen in FIG. 1, and is set so it clears the surface 14 by a half-inch or so. Alternatively it can be set to contact the surface, but this wears out the front brush rapidly. Rear brush 24 rotates clockwise as shown in FIG. 1 or FIG. 2, and front brush 38 rotates counterclockwise as seen in FIG. 1. The speed of front brush 38 may be set within rather wide limits; for example, if rear brush 24 is set at 400 RPM, the speed of front brush 38 may be set between 500 and 1000 RPM, with 650 RPM being perhaps a preferred speed.

Front brush 38 is supported between two brush arms 40 (only one shown). A hydraulic motor 42 is mounted on one brush arm 40 to rotate front brush 38 and is supplied by hydraulic hoses indicated at 44. The opposite brush arm 40 (not shown) carries an idler bearing assembly which rotatably supports the opposite end of front brush 38. A torsionally stiff cross member 46 connects brush arms 40 together so that both ends of front brush 38 stay in alignment. Brush arms 40 are pivotally mounted at two transversely aligned points 28, near the side members of frame 12. As shown in FIGS. 1 and 2, front brush arms 40 and rear brush arms 26 are pivoted at the same points 28. This is only a matter of convenience; separate pivot points might be selected.

A hydraulic cylinder 48 is connected by a cable assembly 50 to one of the front brush arms 40 as shown in FIG. 1, or optionally the cable assembly 50 may be connected to a lug welded to cross member 46. Cylinder 48 can lower the front brush 38 to a working position shown in FIG. 1 or raise it to a stowed position shown in FIG. 2. When front brush 38 is in the position shown in FIG. 1, the brush arms 40 will rest against the outside of brush wrap 52, which will control the height of front brush 38 relative to surface 14. Cable assembly 50 may be slack.

The sweeper has structure which cooperates with rear brush 24 and on occasion also with front brush 38 to sweep debris off of surface 14. For the most part this structure is very similar to the equivalent structure found in a conventional direct forward throw sweeper, for example, as shown in U.S. Pat. Nos. 3,189,931 and 3,304,572. This structure includes a conventional brush wrap 52, which is a heavy gauge sheet steel wrapper behind and above the brushes. In a conventional sweeper the brush wrap may have slots in its rear wall through which the brush arms pass, and these slots are used in the present invention, with rear brush arms 26 passing through them. Two additional slots are added in the present invention near the top of the brush wrap for the front brush arms 40 to pass through. In conventional fashion, each slot is sealed against air leakage by a sheet rubber diaphragm (not shown) with a slit in it through which the brush arm passes. A conventional recirculation lip 54 assists in clean sweeping, and a conventional rubber drag skirt 56 assists in dust control. A door (not shown) on each side of the sweeper gives access to the brushes. Below these doors and the sweeper frame 12 there are rubber side skirts 58 which hang down almost to the surface 14 to assist in dust control. These side skirts 58 are conventional except for one feature. They have arcuate slits 60 which accommodate the hydraulic motor 42 and the idler bearing assembly that drive and support the front brush 38. These elements are mounted outside of the side skirts 58, so they need access through the skirts to the front brush 38. A top cross slit 62 (FIG. 1) and a bottom cross slit 64 (FIG. 2) assist the side skirt 58 to fit snugly around the hydraulic motor and the idler bearing with a minimum of air leakage. The frame side members to which the side skirts are attached have deep arcuate notches 66 cut in them, also to accommodate the front brush drive motor and idler bearing.

A conventional debris hopper 68 is located in front of the rear brush 24 and the front brush 38, or to the left of them as seen in FIGS. 1 and 2. It has a flexible rubber sweeping lip 70 which lifts up to admit debris to the brushes. This lip, which is entirely conventional, drags on surface 14 and serves as a ramp or "dust pan lip" to prevent the dense debris such as sand thrown forward by brush 24 from being thrown under the hopper. The hopper 68 is sealed to the brush wrap 52 by a compressible seal 72. When the hopper gets full there are hydraulic means that separate it from the rest of the machine along this seal, then move and tip it as necessary for dumping it. The hopper and the means for dumping it are entirely conventional, and so will not be further described.

In FIG. 2 a group of arrows indicates the general trajectory followed by debris when thrown only by brush 24 into hopper 68. Note that it is a relatively low trajectory. This works well for dense debris such as sand and gravel, and full hopper loads are obtained. However, less dense debris tends to follow a higher trajectory and is slowed or stopped by air resistance before it has travelled far, so much of it falls in the rear of the hopper, near sweeping lip 70. Such debris piles up and blocks the hopper entrance before the hopper is fully loaded.

In FIG. 1 a group of arrows shows the general trajectory followed by debris when thrown into hopper 68 by the cooperative action of rear brush 24 and front brush 38 in the so-called two-tool mode of operation. It is a much higher trajectory than shown in FIG. 2. This extra height keeps the debris airborne longer, so it has time to move to the front of the hopper before it settles to the hopper floor. Good hopper loads of light debris ar obtained by this method.

In the so-called conventional mode of operation the front brush 38 is raised to the position shown in FIG. 2, and it does not rotate. However, it is possible to rotate it, if desired, by using suitable hydraulic and electric control circuitry. It has been found advantageous under certain circumstances to rotate it in a clockwise direction as shown by arrow 102 in FIG. 2, thus providing the so-called assisted conventional mode of operation which was discussed earlier.

It should be noted that a person versed in the art of sweeper construction would recognize that if one wished to do so one could build a sweeper having only the conventional mode and the assisted conventional mode and not the two-tool mode. In such a sweeper the front brush would be permanently mounted in a rotatable fashion in the position that it occupies in FIG. 2 and one would dispense with the mechanism for raising and lowering it.

Figure 3:
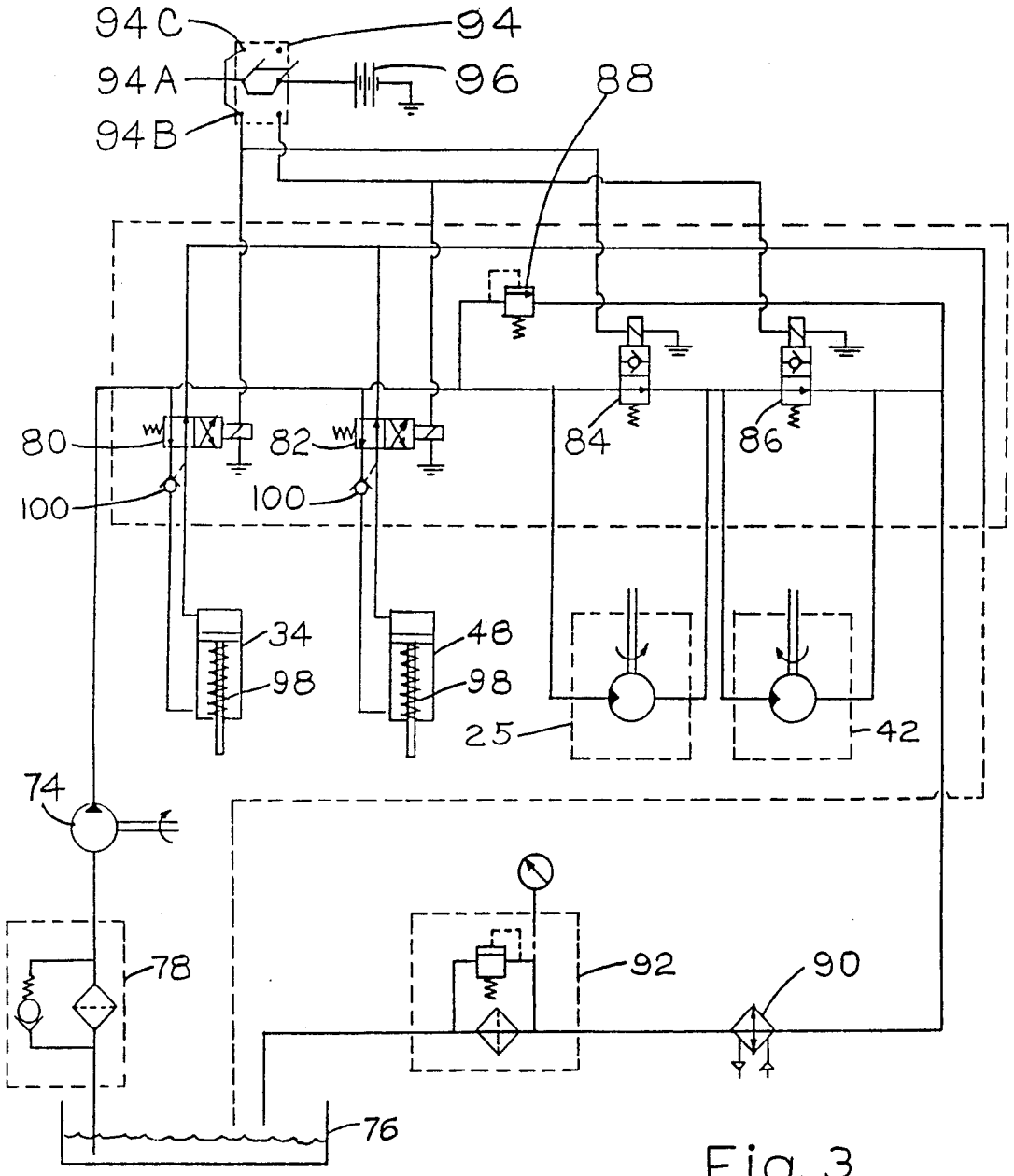
FIG. 3 is a schematic diagram of a sweeper having only conventional mode and two-tool mode, showing the hydraulic means for lifting, lowering and rotating the brushes, also the electrical controls for those means.

Refer now to FIG. 3, which is a schematic diagram of the hydraulic system used to rotate and to lift or lower front brush 38 and rear brush 24, together with the electrical circuitry used to control these functions in a sweeper equipped only for conventional mode and two-tool mode operation. FIG. 3 as drawn shows the condition when both brushes are raised for transport and are not rotating. Both brushes are operated in similar manner.

A hydraulic pump 74 is mechanically coupled to the engine which powers the sweeper. Hydraulic oil is supplied from a reservoir 76, and passes through a filter screen 78 to enter the suction side of pump 74. Hydraulic cylinder 34 raises and lowers the rear brush 24 and is controlled by solenoid valve 80, while hydraulic cylinder 48 raises and lowers front brush 38 and is controlled by solenoid valve 82. Hydraulic motor 25 rotates the rear brush 24 and is controlled by solenoid valve 84, while hydraulic motor 42 rotates the front brush 38 and is controlled by solenoid valve 86. Relief valve 88 protects the system in the event of an overload condition in either of the brush motors. The hydraulic oil passes in series through an oil cooler 90 and a final filter 92 and then returns to reservoir 76.

One double pole double throw switch 94 is located where the sweeper operator can reach it conveniently. It is supplied by a 12-volt battery 96 on the sweeper. It controls the raising and lowering and the rotation of both the front brush 38 and the rear brush 24. Switch 94 can be placed in any one of three positions. In a centered position as shown in FIG. 3 and termed position 94A, both brushes are raised to transport position and neither one will rotate. In a lower switch position, termed position 94B, both brushes will be lowered to the surface to be swept and both will rotate, thus providing a two-tool sweeping mode for sweeping light debris such as paper items or dry leaves. In an upper switch position, termed position 94C, the front brush 38 will be raised and shut off while the rear brush 24 will be lowered to the surface 14 and will rotate, thus providing a conventional direct forward throw sweeping mode for sweeping small, dense debris such as sand and gravel.

Consider the centered switch position 94A, which is the switch position shown in FIG. 3. No current flows through the switch 94, so the solenoid valves 80, 82, 84, and 86 are not activated, and when they are not activated the oil flow passages in them are aligned as shown in FIG. 3. Thus oil from pump 74 passes directly through valves 84 and 86, bypassing the brush motors 25 and 42, and passing in series through oil cooler 90 and final filter 92 before returning to the reservoir 76. The combined pressure drop through the oil cooler and the final filter, together with the loss in the connecting lines and fittings, is about 100 psi. This pressure is in the system, and is exerted through valves 80 and 82 on the rod ends (lower ends as seen in FIG. 3) of hydraulic cylinders 34 and 48. These cylinders are equipped with helper springs 98, and the combined forces of the springs and the 100 psi pressure acting on the cylinder pistons are enough to lift the brushes and hold them up so long as the pump 74 is running. During machine shut downs the check valves 100 will hold the oil in the cylinders and keep the brushes up. Thus centered switch position 94A stops the rotation of both front brush 38 and rear brush 24 and places both of them in their lifted, transport positions.

In the lower switch position 94B all four solenoid valves (80, 82, 84 and 86) are activated. The flow of oil through valves 84 and 86 is blocked, forcing it to pass through brush motors 25 and 42 in series, which causes brushes 24 and 38 to rotate. Doing this work builds up substantial pressure in the system. Valves 80 and 82 now direct oil to the head ends of cylinders 34 and 48 (upper ends as seen in FIG. 3). Check valves 100 are pilot operated, and pressure in the lines going to the head ends of the cylinders will unseat the checks, so oil from the rod ends of the cylinders will be released to the low pressure side of the system. The pressure in the system will overcome the helper springs 98 and the brushes will lower to their working positions on the surface 14 being swept. Thus the lower switch position 94B gives the two-tool sweeping mode for sweeping light debris such as crumpled paper objects or dry leaves.

In the upper switch position 94C only valves 80 and 84 are activated. These will lower the rear brush 24 to the surface being swept and cause it to rotate, as described above in discussing switch position 94B. Since valves 82 and 86 are not activated, the front brush 38 will be held up and not rotated, as described above in discussing switch position 94A. Thus the upper switch position 94C gives conventional sweeping mode with the rear brush only for sweeping small dense debris such as sand and gravel.

Figure 4:
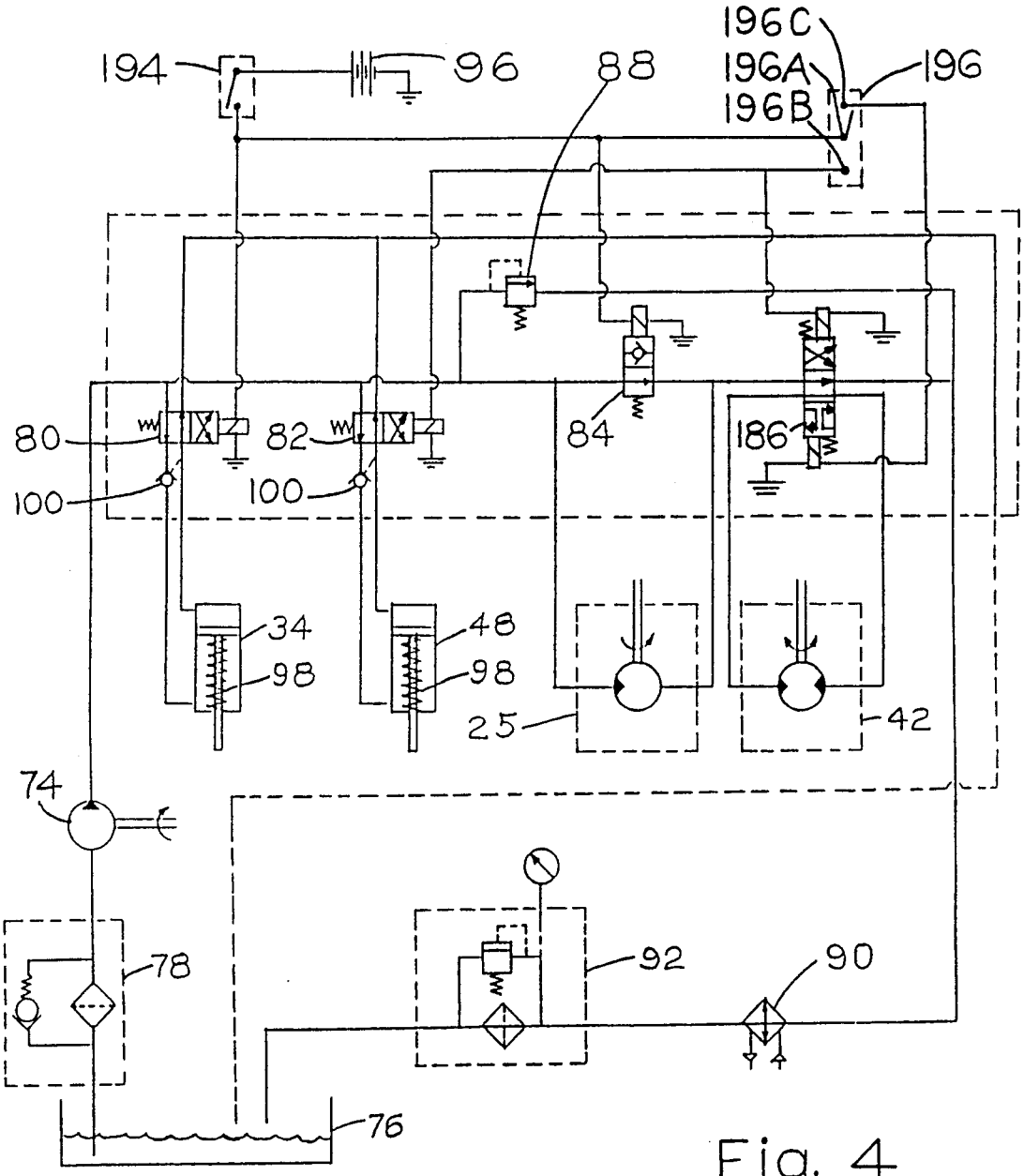
FIG. 4 is similar to FIG. 3, but shows a hydraulic circuit and its electrical controls for a sweeper which can operate in conventional mode, assisted conventional mode or two-tool mode.

FIG. 4 shows hydraulic and electrical circuitry similar to that shown in FIG. 3, but modified to provide for the assisted conventional sweeping mode in addition to the conventional mode and the two-tool mode. In assisted conventional mode the rear brush 24 is down and rotating as in the conventional and two-tool modes. The front brush 38, however, is raised as shown in FIG. 2 and rotated clockwise as shown by arrow 102, which is opposite to its rotation in the two-tool mode as shown in FIG. 1. Somewhat different hydraulic valving and electric controls are required to provide these features.

In FIG. 4 a 3-way spring-centered solenoid valve 186 has replaced valve 86 and two switches 194 and 196 have replaced switch 94. Hydraulic motor 42 is unchanged, but its capability for bidirectional rotation is indicted. With the valve and switch positions as shown both brushes are raised and not rotating.

When switch 194 is closed, valves 80 and 84 will be energized, causing rear brush 24 to be lowered by cylinder 34 and rotated by motor 25. In addition, current will be available to single pole double throw switch 196, which controls valves 82 and 186. In its neutral (off) position 196A, valves 82 and 186 will not be energized, which will result in front brush 38 being lifted and not rotated. In the lower switch position 196B, valve 82 and a first end of valve 186 will be energized, so front brush 38 will be lowered by cylinder 48 and caused to rotate by motor 42. Its direction of rotation will be controlled by how the hydraulic lines 44 are attached to hydraulic motor 42, and should be set up to be counterclockwise as seen in FIG. 1. In the upper switch position 196C, valve 82 will not be energized, so front brush 38 will not be lowered, but a second end of valve 186 will be energized to cause motor 42 to rotate opposite to its rotation resulting from switch position 196B, or clockwise as seen in FIG. 2.

Thus closing switch 194 and placing switch 196 in its open position 196A gives conventional sweeping mode, with front brush 38 up and not rotating. While switch 194 is closed, moving switch 196 to position 196B gives two-tool mode, with front brush 38 down and rotating counterclockwise as seen in FIG. 1. Again with switch 194 closed, moving switch 196 to position 196C gives assisted conventional mode, with front brush 38 up and rotating clockwise as seen in FIG. 2. In all three modes rear brush 24 rotates clockwise as seen in FIGS. 1 and 2. Both brushes will be raised and stopped from rotating when switch 194 is open.

While the preferred form of the invention has been shown and described, it should be realized that there can be many modifications, substitutions and alterations thereto. We therefore wish that the invention be unrestricted except as by the appended claims.

The embodiments of the invention in which an exclusive property or privilege is claimed are defined as follows:

1. A sweeper movable over a surface to be swept, including a frame having a longitudinal axis parallel to the direction of sweeper movement, a debris hopper mounted on a front portion of the frame, an opening in the rear of the debris hopper to admit debris therein, a first tool comprising a rotatable cylindrical brush having an axis transverse to the longitudinal axis of the frame, said first tool being located behind the debris hopper, in the direction of movement of the sweeper, means for rotating said first tool to move debris through a particular trajectory into said debris hopper, a second tool comprising a rotatable cylindrical means having an axis transverse to the longitudinal axis of the frame, said second tool being movable between a sweeping position in which it is located between said first tool and said hopper and is adjacent the surface to be swept, and a non-sweeping position in which said second tool is located away from the surface to be swept and above the trajectory of debris moved by said rotatable cylindrical brush while said second tool is in said non-sweeping position, means for moving said second tool between said sweeping and non-sweeping positions, and means for rotating said second tool when in said sweeping position.

2. The sweeper of claim 1 further characterized in that said second tool is a rotatable brush.

3. The sweeper of claim 1 further characterized by and including means for moving both said first tool and said second tool between sweeping and non-sweeping positions and for causing rotation of said first and second tools when in said sweeping positions.

4. The sweeper of claim 3 further characterized in that the means for moving said first and second tools and for causing rotational operation thereof include a fluid circuit, a fluid motor for rotating said first tool and a fluid motor for rotating said second tool, and fluid means, in said fluid circuit, for raising and lowering said first and second tools between said sweeping and non-sweeping positions.

5. The sweeper of claim 4 further characterized in that said fluid circuit includes a pump and filter.

6. The sweeper of claim 4 characterized by and including control means for causing operation of said fluid motors.

7. The sweeper of claim 4 further characterized in that said fluid means includes fluid cylinders, one for raising and lowering said first tool and one for raising and lowering said second tool.

8. The sweeper of claim 7 further characterized by and including control means for causing operation of said fluid cylinders to raise and lower said first and second tools and to independently raise and lower said first tool.

9. The sweeper of claim 1 further characterized by and including means for moving said first tool between sweeping and non-sweeping positions.

10. The sweeper of claim 9 further characterized by and including means for rotating said tools in the same direction when said first tool is in a sweeping position and said second tool is in a non-sweeping position.

11. The sweeper of claim 1 further characterized by and including means for rotating said first and second tools in opposite directions when said tools are in the sweeping position.

12. A multi-mode sweeper for use in sweeping both dense debris such as sand and gravel in a first mode and light debris such as paper and dry leaves in a second mode including a frame having a longitudinal axis parallel to the direction of sweeper movement, means for moving the frame mounted thereon, a main cylindrical sweeping brush mounted on the frame and extending transverse to the longitudinal axis of the frame, a debris hopper mounted on the frame forward of the main brush and having a hopper opening facing said main brush, means for raising and lowering said main brush between sweeping and non-sweeping positions, means for rotating said main brush about its central axis, an auxiliary cylindrical tool extending transverse to the longitudinal axis of the frame mounted on said frame between said debris hopper and said main brush, means for rotating said auxiliary tool about its central axis, means independent of said means for raising and lowering said main brush for raising and lowering said auxiliary tool between sweeping and non-sweeping positions whereby said auxiliary tool is in a non-sweeping position and said main brush is in a sweeping position in said first mode of sweeper operation and debris from said main brush moves through a first trajectory toward said hopper opening, and said auxiliary tool and said main brush are both in a sweeping position in said second mode of operation, whereby debris movement resulting from rotation of said main brush and said auxiliary tool has a higher trajectory than said first trajectory in moving toward said hopper.

13. The sweeper of claim 12 further characterized in that said main brush is mounted to a pair of main brush arms pivotally mounted to said frame, and said auxiliary tool is mounted to a pair of auxiliary arms pivotally mounted to said frame.

14. The sweeper of claim 13 further characterized by and including independent fluid operated means for pivoting said main brush arms and said auxiliary arms for independent movement thereof.

15. The sweeper of claim 13 further characterized in that said main brush arms and said auxiliary arms are coaxially pivotally mounted.

16. The sweeper of claim 12 further characterized in that said auxiliary tool is away from the path of debris moving from said main brush toward said hopper opening when said auxiliary tool is in the non-sweeping position.

17. The sweeper of claim 12 further characterized in that said auxiliary tool is generally above said first trajectory when in a non-sweeping position and including means for rotating said auxiliary tool when in said non-sweeping position to provide a third mode of operation for both dense and light debris in which rotation of said auxiliary tool assists movement of light debris into said hopper.

18. The sweeper of claim 17 further characterized in that said main brush and auxiliary tool are rotated in the same direction in said third mode of operation.

* * * * *